US010493475B1

(12) United States Patent
Yang

(10) Patent No.: US 10,493,475 B1
(45) Date of Patent: Dec. 3, 2019

(54) PUMP TYPE LIQUID AIRTIGHT CONTAINER

(71) Applicant: Hyoung Taek Yang, Seoul (KR)

(72) Inventor: Hyoung Taek Yang, Seoul (KR)

( * ) Notice: Subject to any disclaimer, the term of this patent is extended or adjusted under 35 U.S.C. 154(b) by 0 days.

(21) Appl. No.: 16/275,049

(22) Filed: Feb. 13, 2019

(30) Foreign Application Priority Data

Jun. 15, 2018 (KR) ..... 10-2018-0069088

(51) Int. Cl.
*B05B 11/00* (2006.01)

(52) U.S. Cl.
CPC ..... *B05B 11/3001* (2013.01); *B05B 11/3087* (2013.01)

(58) Field of Classification Search
CPC ..... B05B 11/3001; B05B 11/3087; B05B 11/3035; B05B 11/3064; B05B 11/3067; B05B 11/3069
See application file for complete search history.

(56) References Cited

U.S. PATENT DOCUMENTS 4,732,549 A * 3/1988 von Schuckmann ..... B05B 11/3059 222/153.13
5,205,441 A * 4/1993 Andris ..... B05B 11/007 222/207
5,238,156 A * 8/1993 Andris ..... B05B 11/007 222/207
5,306,125 A * 4/1994 Weag ..... B05B 11/0027 417/472
5,351,862 A * 10/1994 Weag ..... B05B 11/0048 222/145.3
5,544,789 A * 8/1996 Gillingham ..... B05B 11/3033 222/153.13
5,664,703 A * 9/1997 Reifenberger ..... B05B 11/0064 222/207
6,755,327 B1 * 6/2004 Hazard ..... B05B 11/3035 222/209
7,677,415 B2 * 3/2010 Auer ..... B05B 11/3035 222/207
7,878,374 B2 * 2/2011 Decottignies ..... A45D 40/20 222/207
8,206,136 B2 * 6/2012 Brouwer ..... B05B 11/3033 222/214
8,240,516 B2 * 8/2012 Lautre ..... B05B 11/0029 222/153.13
10,357,792 B2 * 7/2019 Schroeder ..... B05B 11/3035
2010/0116849 A1 * 5/2010 Lautre ..... B05B 11/0029 222/153.13
2010/0294805 A1 * 11/2010 Pohlmann ..... B05B 11/0072 222/207
2012/0024904 A1 * 2/2012 Doulin ..... B05B 11/3035 222/207
2014/0103071 A1 * 4/2014 Park ..... A45D 34/00 222/207

FOREIGN PATENT DOCUMENTS

KR 20-0456238 Y1 10/2011

* cited by examiner

*Primary Examiner* — Frederick C Nicolas
(74) *Attorney, Agent, or Firm* — Novick, Kim & Lee, PLLC; Sang Ho Lee

(57) ABSTRACT

Provided is a pump-type airtight liquid container, and more particularly, to a pump-type airtight liquid container having an improved, simplified structure that provides higher airtightness and effectively allows total discharge of liquid content therefrom.

5 Claims, 8 Drawing Sheets

PUMP TYPE LIQUID AIRTIGHT CONTAINER

CROSS-REFERENCE TO RELATED APPLICATION

This application claims the priority of Korean Patent Application No. 10-2018-0069088, filed on Jun. 15, 2018, in the Korean Intellectual Property Office, the disclosure of which is incorporated herein in its entirety by reference.

BACKGROUND

1. Field

One or more embodiments relate to a pump-type airtight liquid container, and more particularly, to a pump-type airtight liquid container having an improved, simplified structure that provides higher airtightness and effectively allows total discharge of liquid content therefrom.

2. Description of the Related Art

In general, liquid containers storing liquid content such as cosmetics, medical reagents, or the like include a pumping device to discharge a certain amount of the content to the outside by using pressure. The pumping device (pumping unit) is classified into various types such as an airless type in which content is blocked from air, a bubble type in which foam is formed by air entrance, and a deep tube-type in which a pipe is connected to a bottom of a container to draw up the content.

In an airless-type liquid container, when a user presses a push button with the finger, a pressure generated thereby creates vacuum pressure inside the container, and a certain amount of content contained inside the container is discharged through a nozzle to the outside via the vacuum pressure the outside. A deep tube-type liquid container includes a pipe which communicates the inner side and the outside of the container via a pressure generated when a user presses a push button to thereby absorb content and discharge the content to the outside.

Although the liquid containers according to the related art as described above allow a user to easily discharge the content by pressing a push button, it is difficult to completely discharge up to a small amount of remaining content in the container a structure of the containers is complex. Also, it is difficult to maintain airtightness after repeated use.

Korean Utility Model No. 20-0456238 entitled "Container for Ejecting Foam" discloses a related technology.

SUMMARY

One or more embodiments include a pump-type airtight liquid container that is capable of completely and effectively discharging liquid or gel content and has a simplified structure and high airtightness.

Also, one or more embodiments include a pump-type airtight liquid container that is capable of preventing leakage, through a gap generated between internal elements of the airtight liquid container, of a liquid discharged out of the airtight liquid container.

Additional aspects will be set forth in part in the description which follows and, in part, will be apparent from the description, or may be learned by practice of the presented embodiments.

According to one or more embodiments, a pump-type airtight liquid container includes: a body having a long cylindrical shape having an open upper portion to form an accommodation space to accommodate liquid content; a connection cover inserted into the upper portion of the body to define the accommodation space and form an arrangement space having an open upper portion, the connection cover including a communication port at a lower portion thereof facing the accommodation space, wherein the accommodation space and the arrangement space communicate with each other via the communication port; a checking plate mounted at the communication port and closing or opening the communication port when lowered or raised by vacuum pressure; an elastic pump including a flexible material, having a long shape, and arranged in the arrangement space of the connection cover to move the content accommodated in the accommodation space, the elastic pump including a movement passage that communicates with the accommodation space and through which the content is moved in a length direction when the communication port is opened when the checking plate is raised; a discharge button liftably inserted into the upper portion of the connection cover to discharge the content accommodated in the movement passage to the outside and including a discharge path that communicates with the outside and a sealing protrusion ring that is inserted into the movement passage to airtightly seal the movement passage, wherein, when the communication port is closed when the checking plate is lowered, the discharge button when lowered generates the vacuum pressure in the movement passage to deform a shape of the discharge tube of the elastic pump closely adhering to the sealing protrusion ring such that the discharge path and the movement passage communicate with each other; and a fixing ring fixed in an annular space between the connection cover and the elastic pump when a surface of the connection cover facing a lower end portion of the elastic pump is in contact with the lower end portion of the elastic pump installed in the connection cover to maintain sealing and prevent occurrence of a gap between the lower end portion of the elastic pump and the connection cover.

The discharge button may form a communication flow passage connected to the discharge path when the shape of the discharge tube is modified by the vacuum pressure.

The connection cover may include an insertion portion having a concave shape in a lower portion of the connection cover, wherein the communication port is formed in a center of the insertion portion.

The checking plate may include: an insertion ring having a ring shape and being inserted into the insertion portion; an opening and closing member having a shape corresponding to an inner shape of the communication port and opening or closing the communication port; and a plurality of connection ribs extending from an internal circumferential surface of the insertion ring to be connected to an outer circumferential surface of the opening and closing member such that the opening and closing member is raised when the opening and closing member is connected to the insertion ring.

The pump-type airtight liquid container may further include: a push piston that has a plate shape and is liftably arranged in the accommodation space to move content when the communication port is opened when the discharge button is raised, wherein the push piston pushes up the content to the movement passage when the push piston is raised by vacuum pressure, divides the accommodation space, and forms an air inflow space in which the air is input through an inlet formed in a lower portion of the body.

The discharge tube may have a dual structure to increase airtightness of the movement passage and include an insertion groove into which the sealing protrusion ring is inserted and a plurality of fluid connection ports which are formed in a portion of the discharge tube in an inner position and via which the movement passage and the insertion groove communicate with each other.

The sealing protrusion ring may include a connection port provided at an alternate position with respect to the fluid connecting port to easily discharge the content and allow the movement passage and the communication flow passage to communicate with each other.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

A pump-type airtight liquid container according to an embodiment of the present disclosure now will be described more fully hereinafter with reference to the accompanying drawings.

Figure 1:
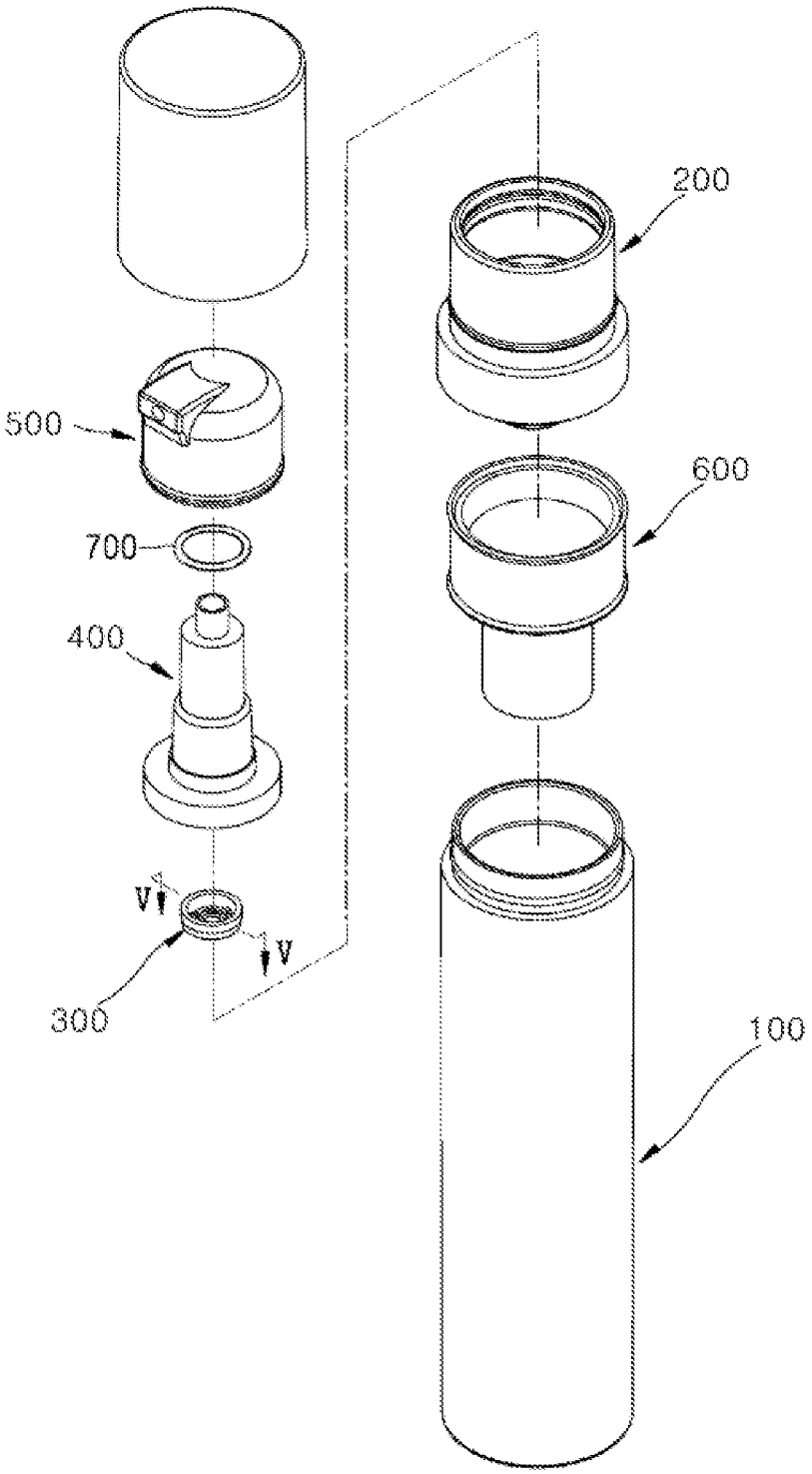
FIG. 1 is a disassembled perspective view of a pump-type airtight liquid container according to an embodiment of the present disclosure.
Figure 2:
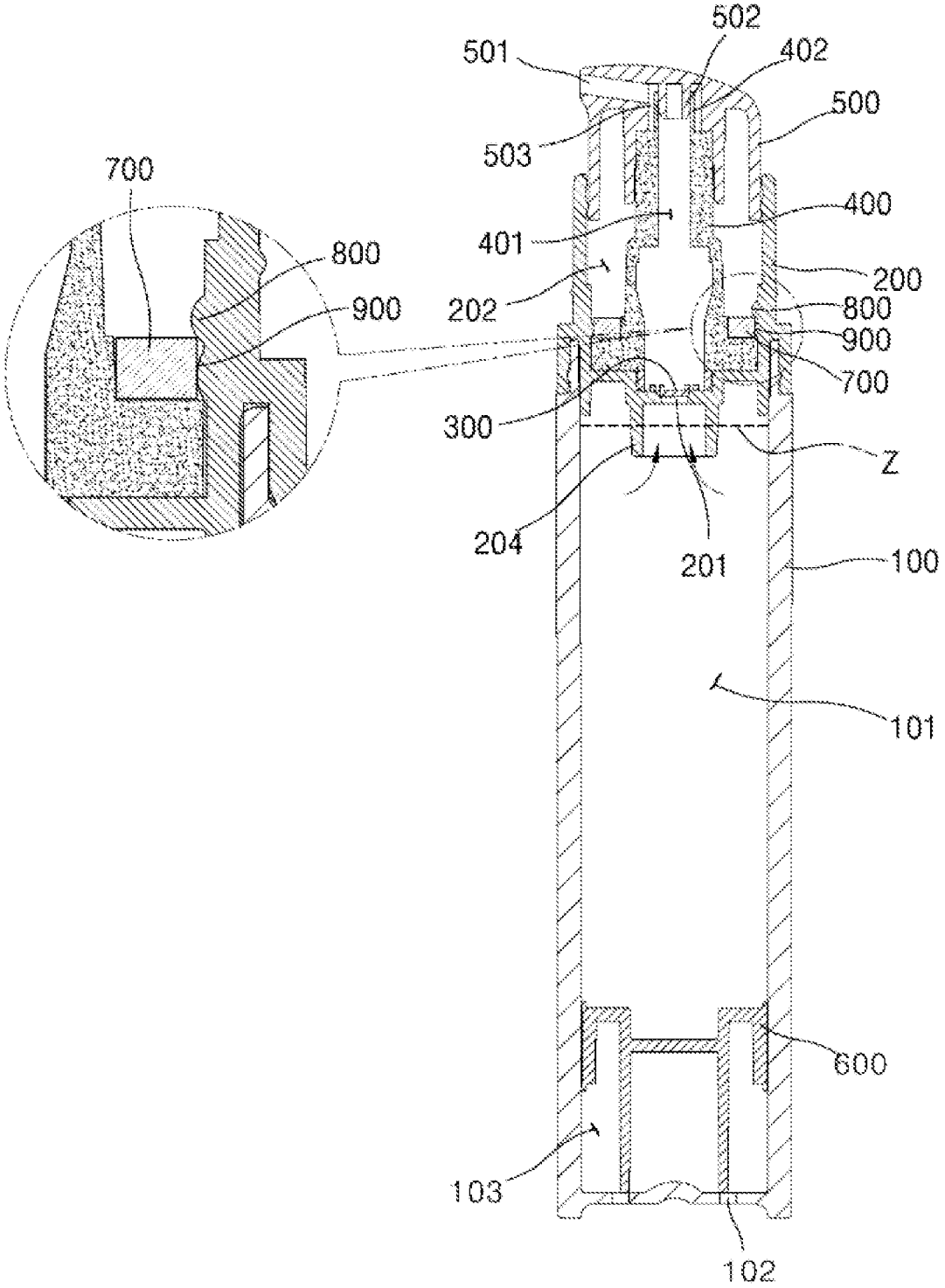
FIG. 2 is a cross-sectional view of the pump-type airtight liquid container according to an embodiment of the present disclosure.
Figure 3:
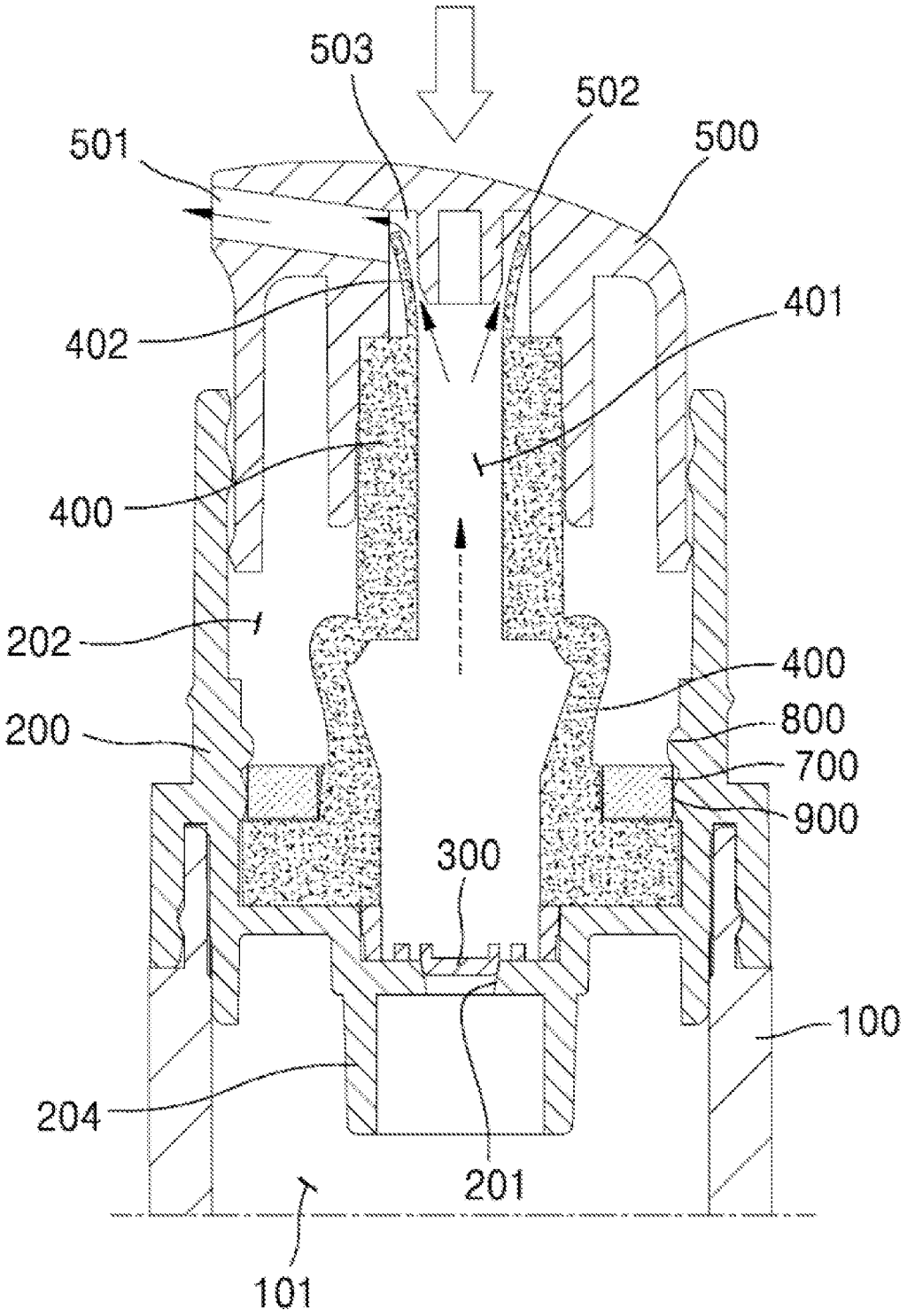
FIG. 3 is a partial cross-sectional view for describing discharging of content to the outside via an elastic pump when a discharge button used in an embodiment of the present disclosure is lowered.
Figure 4:
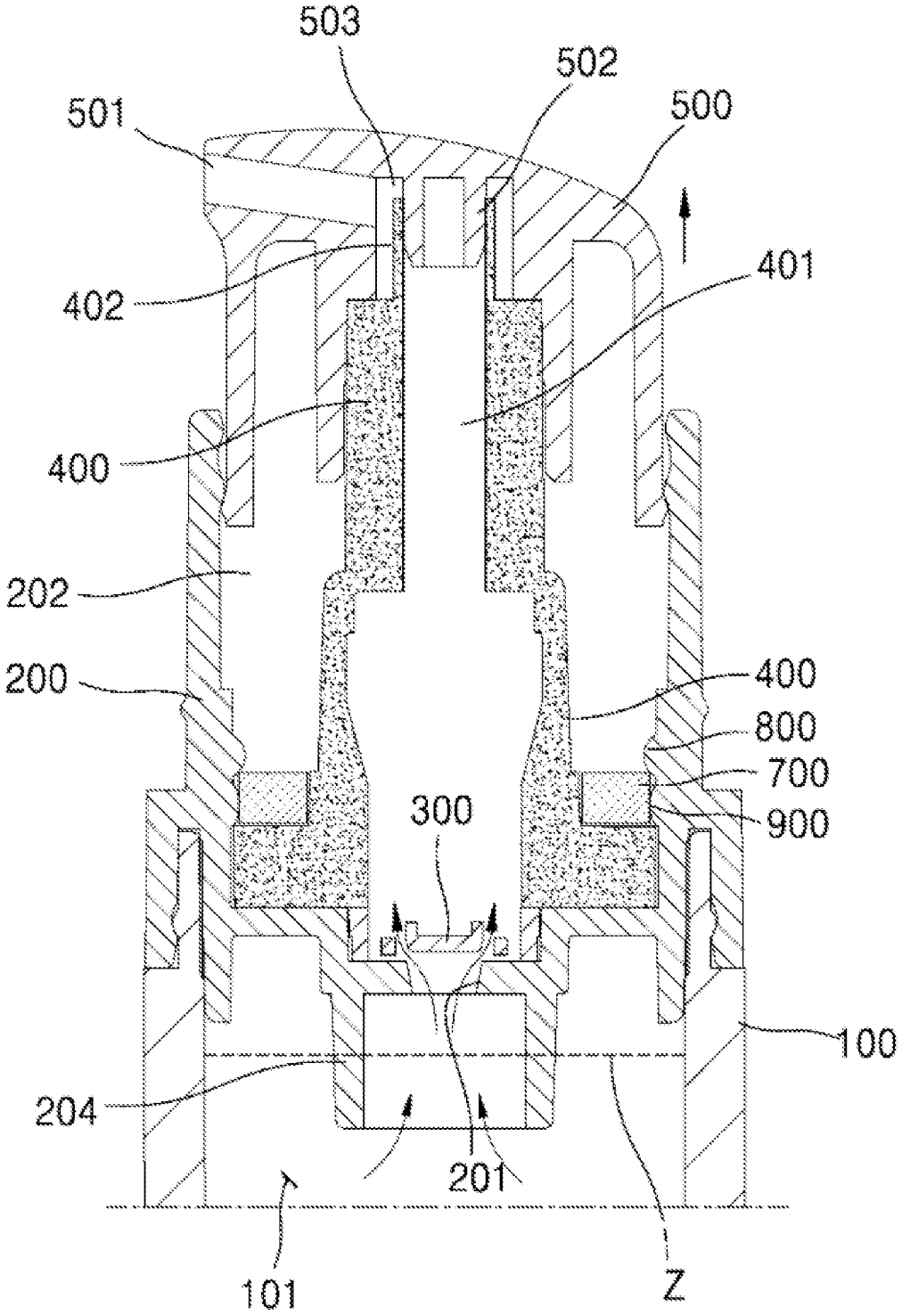
FIG. 4 is a partial cross-sectional view for describing flowing of content into a flow passage of the elastic pump when the discharge button used in an embodiment of the present disclosure is raised.
Figure 5:
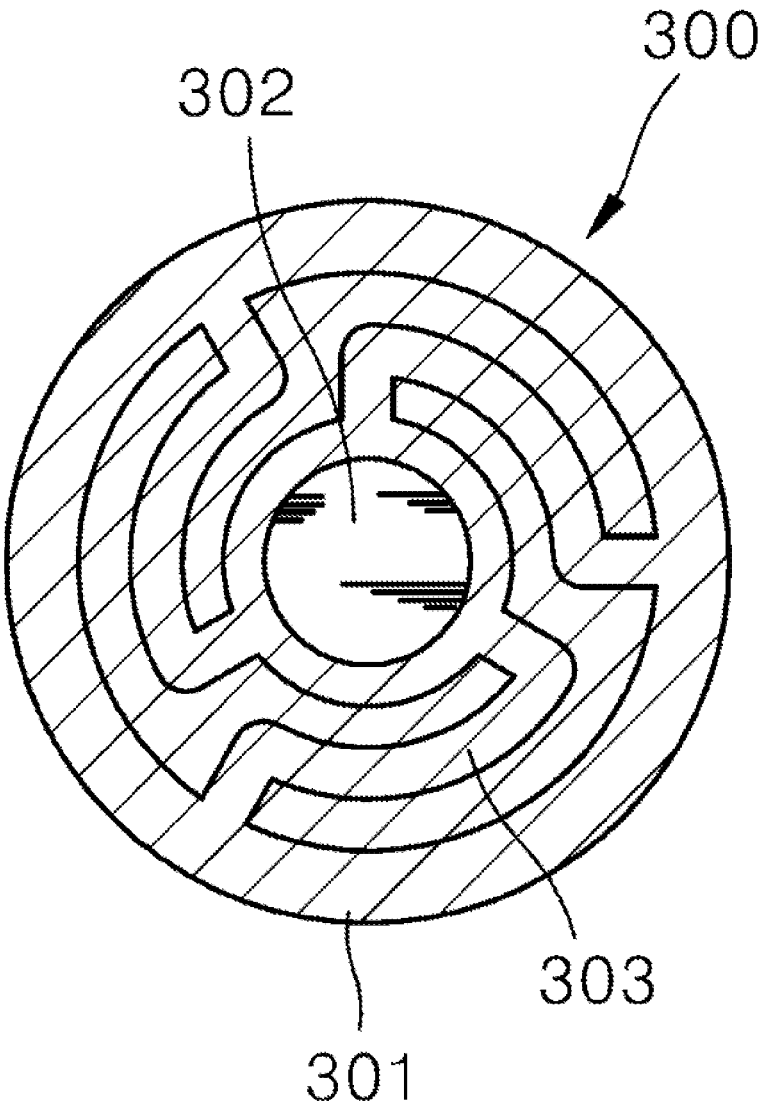
FIG. 5 is a cross-sectional view of the pump-type airtight liquid container taken along line V-V of FIG. 1.

FIG. 1 is a disassembled perspective view of a pump-type and airtight liquid container according to an embodiment of the present disclosure. FIG. 2 is a cross-sectional view of the pump-type airtight liquid container according to an embodiment of the present disclosure. FIG. 3 is a partial cross-sectional view for describing discharging of content to the outside via an elastic pump when a discharge button used in an embodiment of the present disclosure is lowered. FIG. 4 is a partial cross-sectional view for describing flowing of content into a flow passage of an elastic pump when a discharge button used in an embodiment of the present disclosure is raised. FIG. 5 is a plan view of the pump-type airtight liquid container taken along line V-V of FIG. 1.

As illustrated in the drawings, the pump-type airtight liquid container according to an embodiment of the present disclosure may include a body 100, a connection cover 200, a checking plate 300, an elastic pump 400, a discharge button 500, and a fixing ring 700 (see FIGS. 1 and 2).

The body 100 may have a cylindrical shape with an open upper portion, extend in a lengthwise direction, and form an accommodation space 101 for accommodating liquid content. The body 100 may include a material of a certain strength, such as a plastic or an acryl, and a transparent material so as to allow content identification.

The accommodation space 101 is formed by the upper portion of the body 100 that is opened and the connection cover 200 that is coupled to the upper portion thereof. The body 100 may be coupled to the connection cover 200 by using various methods, but may preferably be attachably/detachably coupled to the connection cover 200 by using an insertion coupling method.

As the body 100 includes a transparent material and is attachably/detachably coupled to the connection cover 200, a user may easily identify content contained inside the body 100, and fill content in the accommodation space 101 by separating the connection cover 200.

The content accommodated in the accommodation space 101 of the body 100 refers to a liquid-state material such as cosmetics, medical reagents or the like, and may also include a gel-type material having certain viscosity.

The connection cover 200 is attachably/detachably inserted into the open upper portion of the body 100 to define the accommodation space 101, and forms an arrangement space 202 having an open upper portion. The connection cover 200 includes a communication port 201 formed in a lower portion thereof facing the accommodation space 101 and communicating the accommodation space 101 and the arrangement space 202 with each other.

The connection cover 200 may include a material such as a plastic or an acryl, like the body 100, and may preferably have a cylindrical shape having an open upper portion. In addition, the arrangement space 202 of the connection cover 200 is a space in which an elastic pump 400 is installed and also an insertion space into which the elastic pump 400 is inserted.

The connection cover 200 further includes a discharge guide pipe 204 on a lower surface thereof. The discharge guide pipe 204 has a long shape protruding from the lower surface of the connection cover (200) towards the accommodation space 101, and has a structure surrounding a circumference of the communication port 201. The discharge guide pipe 204 may preferably be formed integrally with the connection cover 200, and communicates the communication port 201 and the accommodation space 101 with each other.

When using the pump-type airtight liquid container for the first time, as air that exists in the accommodation space 101 is discharged to the outside and content is located up to a line Z indicating that the content is fully filled, the discharge guide pipe 204 may be below the line Z such that a portion of the discharge guide pipe 204 is submerged in the content and generates vacuum pressure in a movement passage 401 and the accommodation space 101.

In addition, when the discharge button 500 is pushed upwards to discharge the content, the discharge guide pipe 204 increases an absorption force generated by vacuum pressure in the communication port 201, thereby allowing the content to effectively flow into the movement passage 401 of the elastic pump 400.

The checking plate 300 installed at the communication port 201 in a lower portion of the connection cover 200 is raised by vacuum pressure according to operation of the discharge button 500 to close or open the communication port 201. The checking plate 300 may preferably include a flexible material such as silicon.

For example, the checking plate 300 may close the communication port 201 when the discharge button 500 is pressed, thereby allowing the content contained in the elastic pump 400 to be discharged to the outside by vacuum pressure, through the discharge button 500.

Meanwhile, when the discharge button 500 is returned to the position before it is raised and pressed, the checking plate 300 may be raised to open the communication port 201 to thereby allow the content contained in the accommodation space 101 to be moved to the elastic pump 400. Then the checking plate 300 is lowered after the content is moved, and closes the communication port 201 again.

The elastic pump 400 is formed of a flexible material such as silicon and has a long shape, and is installed in the arrangement space 202 of the connection cover 200. In addition, the elastic pump 400 includes the movement passage 401 extending in a length direction.

When the communication port 201 is opened as the checking plate 300 is raised as described above, the movement passage 401 of the elastic pump 400 communicates with the accommodation space 101 to thereby allow the content to move to the elastic pump 400.

A thickness of a lateral surface of the elastic pump 400 varies with a section thereof. Thus, a section with a relatively small thickness corresponding to a location of the arrangement space 202 contracts when a user presses the discharge button 500, thereby generating vacuum pressure in the movement passage 401 (see FIG. 3).

Meanwhile, the section of the elastic pump 400 that has been contracted returns to its original state when an external force applied to the discharge button 500 is removed, and the discharge button 500 is raised to its original position to thereby allow the content to flow into the movement passage 401 (see FIG. 4).

The elastic pump 400 is inserted into the arrangement space 202 of the connection cover 200 and an upper portion of the elastic pump 400 is coupled to the discharge button 500, and as the shape of the elastic pump 400 is changed or restored by an external force and vacuum pressure is generated to move the content, a structure of the pump-type airtight liquid container may be simplified and the content may be effectively discharged.

The discharge button 500 includes a discharge path 501 and a sealing protrusion ring 502 and is inserted into and coupled to the open upper portion of the connection cover 200. The sealing protrusion ring 502 has a ring shape protruding from an internal lateral surface of the discharge button 500 facing an uppermost end of the elastic pump 400 and is inserted into the movement passage 401 to thereby air-tightly seal the movement passage 401.

A location where the sealing protrusion ring 502 is inserted is an uppermost portion of the elastic pump 400, and a discharge tube 402 is formed at that uppermost portion. The discharge tube 402 is a section that has a smallest thickness and is most adjacent to the discharge path 501 from among the elastic pump 400, and the shape of the discharge tube 402 is changed when vacuum pressure is generated.

The discharge path 501 of the discharge button 500 communicates the movement passage 401 with the outside to allow the content to be discharged to the outside. The discharge path 501 is located adjacent to the discharge tube 402 and communicates the movement passage 401 with the outside when the discharge tube 402 is bent by an external force.

The fixing ring 700 is fixed in an annular space between the connection cover 200 and the elastic pump 400 while a surface of the connection cover (200) facing a lower end portion of the elastic pump 400 is in contact with the lower end portion, thereby maintaining sealing between the lower end portion of the elastic pump 400 installed in the connection cover 200 and the connection cover 200 and preventing a gap therebetween.

The fixing ring 700 may be inserted into and coupled to the annular space by being pressurized by a pressurization rib 900 formed on the connection cover 200 when the fixing ring 700 is inserted into the annular space by an insertion method. The pressurization rib 900 may preferably protrude from an internal lateral surface of the connection cover 200 adjacent to the lower end portion of the elastic pump 400.

The fixing ring 700 does not move from the annular space due to a fixing rib 800 protruding from the connection cover 200 and has a fixed position. The fixing rib 800 protrudes from an inner portion of the connection cover 200 and defines the annular space, thereby forming an insertion space in which the fixing ring 700 may be inserted.

When the fixing ring 700 tends to move due to movement of the elastic pump 400, the fixing rib 800 is brought into contact with an upper lateral surface of the fixing ring 700 to thereby increase a positional fixing force of the fixing ring (700).

According to the pump-type airtight liquid container of an embodiment of the present disclosure having the configuration as described above, liquid or gel content is accommodated in the accommodation space 101 of the body 100, the connection cover 200 including the communication port 201 is coupled to the body 100 to define an accommodation space, the checking plate 300 opens or closes the communication port 201 by vacuum pressure, the elastic pump 400 inserted into the arrangement space 202 of the connection cover 200 contracts or restores to a previous position when the discharge button 500 is raised and generates vacuum pressure in the movement passage 401, the sealing protrusion ring 502 of the discharge button 500 is closely adhered to the discharge tube 402 of the elastic pump 400 and airtightly seals the movement passage 401, the elastic pump 400 allows the content to flow into the movement passage 401, and the shape of the discharge tube 402 is changed by the vacuum pressure to discharge the content to the discharge path 501, thereby the pump-type airtight liquid container completely and effectively discharging the liquid or gel content due to its simplified structure and increased airtightness.

Moreover, according to an embodiment of the present disclosure, when a surface of the connection cover 200 facing the lower end portion of the elastic pump 400 is in contact with the lower end portion, the fixing ring 700 is fixed in the annular space between the connection cover 200 and the elastic pump 400, and when the fixing ring 700 tends to move due to movement of the elastic pump 400, the fixing rib 800 is brought into contact with the upper lateral surface of the fixing ring 700 to increase the positional fixing force of the fixing ring 700, thereby preventing occurrence of a gap between internal components of the pump-type airtight liquid container and leakage of liquid between the internal components when the liquid is discharged to the outside.

The discharge button 500 forms a communication flow passage 503 connected to the discharge path 501. As the content is accommodated in the movement passage 401, the communication flow passage 503 provides a space for the change of the shape of the discharge tube 402 by vacuum pressure due to a pressing operation of the discharge button 500.

In addition, when the shape of the discharge tube 402 is changed and thus the discharge tube 402 is bent toward the discharge path 501 (to the outside), the communication flow passage 503 communicates the discharge path 501 and the movement passage 401 of the elastic pump 400 with each other, thereby producing the effect of easily discharging liquid-state or gel-state content to the outside.

Here, as the discharge button 500 is lowered, vacuum pressure is applied to the checking plate 300 to close the communication port 201 of the connection cover 200, thereby allowing the content to be discharged between the discharge tube 402 and the sealing protrusion ring 502 (see FIG. 3).

The checking plate 300 used in the present embodiment inserted into the insertion portion 203 formed at the communication port 201 in the connection cover 200 and is thus not deviated from the lower portion of the connection cover 200 when the checking plate 300 is raised. The insertion portion 203 has a concave shape in a lower portion of the connection cover 200 facing the accommodation space 101, and the communication port 201 is provided in a center portion of the insertion portion 203.

The checking plate 300 includes an insertion ring 301, an opening and closing member 302, and a plurality of connection ribs 303. The insertion ring 301 has a ring shape and is inserted into the insertion portion 203 of the connection cover 200. The insertion ring 301 may be formed of a silicon material and may also be formed of a material having a certain strength.

The opening and closing member 302 has a shape corresponding to an internal shape of the communication port 201, is raised up by vacuum pressure, and opens or closes the communication port 201. The opening and closing member 302 is connected to the insertion ring 301 via the connection rib 303 such that the opening and closing member 302 is not discharged together with the content to the accommodation space 101 or to the movement passage 401, when the opening and closing member 302 is raised by a pressing operation of the discharge button 500.

The connection ribs 303 may preferably be formed of a flexible material, and extends from an internal circumferential surface of the insertion ring 301 to be connected to an outer circumferential surface of the opening and closing member 302, and the plurality of connection ribs 303 are provided. Thus, the connection ribs 303 derive the effect of raising the opening and closing member 302 while the opening and closing member 302 is connected to the insertion ring 301 (see FIG. 5).

In addition, according to the present embodiment, a push piston 600 push arranged in the accommodation space 101 of the body 100 is further included. The push piston 600 has a plate shape, is liftably arranged in the accommodation space 101, and is raised by vacuum pressure to push up the content to the movement passage 401 of the checking plate 300.

The push piston 600 divides the accommodation space (101) when the push piston 600 is raised, thereby forming, in the accommodation space 101, an air inflow space 103 in which the air is flown in through an inlet 102 formed in a lower portion of the body 100.

That is, when the content is discharged to the outside through the discharge path 501 of the discharge button 500, the push piston 600 pushes up content which is moving through the communication port 201 when the discharge button 500 is returning to its original position, and is raised in proportion to an amount of movement of the content. As the discharge button 500 is raised, the push piston 600 repeatedly pushes up the content to the elastic pump 400, thereby enabling to completely discharge the content in the accommodation space 101.

Above, the pump-type and airtight liquid container according to an embodiment of the present disclosure is described. Hereinafter, a pump-type and airtight liquid container according to another embodiment of the present disclosure will be described with reference to FIG. 6.

Figure 6:
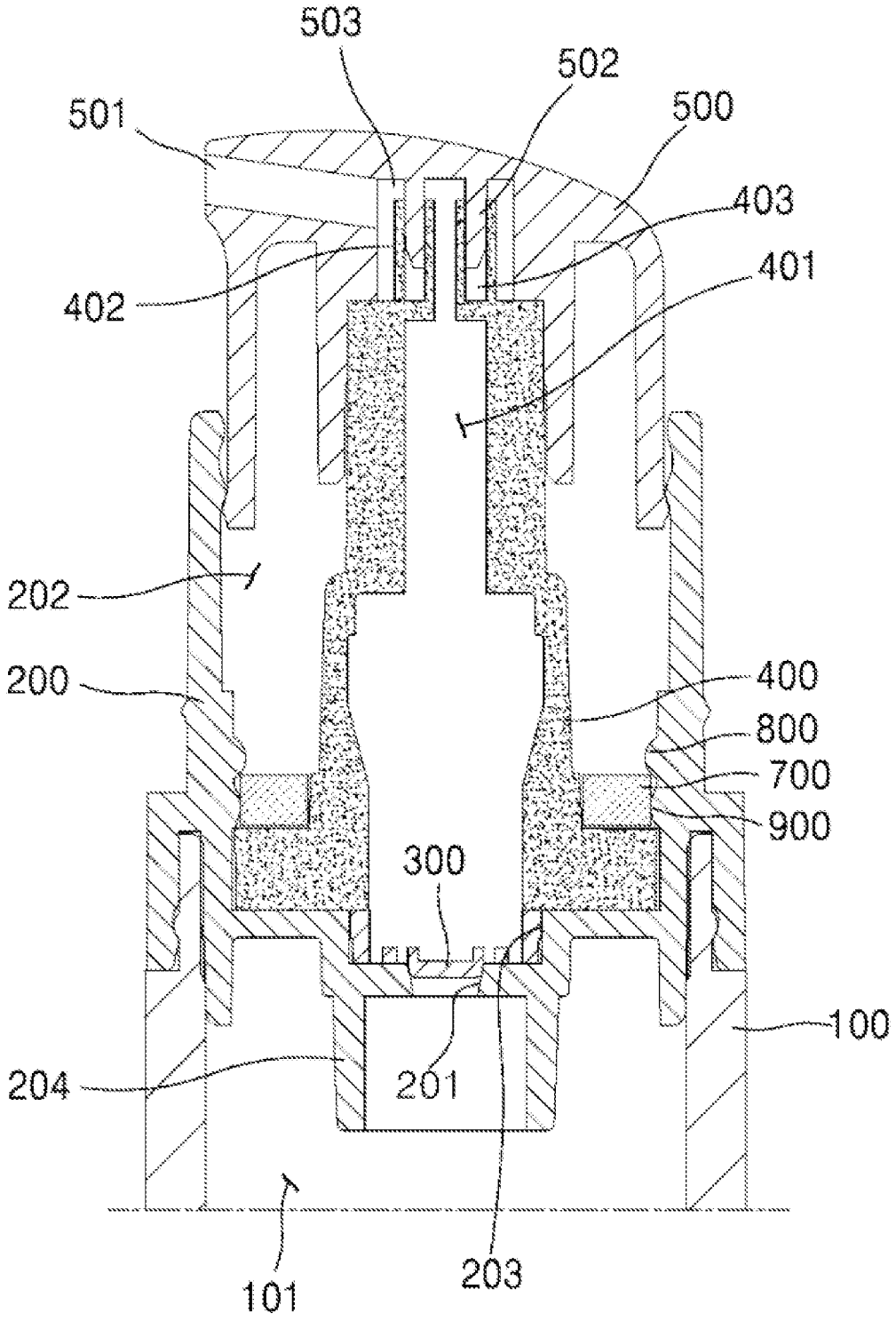
FIG. 6 is a partial cross-sectional view of a discharge tube of an elastic pump according to another embodiment of the present disclosure.

FIG. 6 is a partial cross-sectional view for describing a discharge tube 402 of an elastic pump 400 according to another embodiment of the present disclosure.

As illustrated in FIG. 6, most elements in the present embodiment are similar to those of the above-described embodiment, except in terms of a structure of the discharge tube 402 of the elastic pump 400.

That is, the discharge tube 402 used in the present embodiment has a double structure and thus Includes an insertion groove 403 into which a sealing protrusion ring 502 is inserted. As the sealing protrusion ring 502 is inserted into the insertion groove 403 of the discharge tube 402, the discharge tube 402 is closely adhered to both lateral surfaces of the sealing protrusion ring 502 to thereby derive the effect that the elastic pump 400 air-tightly seals the movement passage 401 of the elastic pump 400 in a two-fold manner when the discharge button 500 is not raised.

When the discharge button 500 is lowered, the discharge tube 402 is separated from the sealing protrusion ring 502 by vacuum pressure so that the content accommodated in the movement passage 401 is discharged to the discharge path 501 by passing through a space formed as the discharge tube 402 is separated from the sealing protrusion ring 502.

The pump-type and airtight liquid container according to the other embodiment of the present disclosure is described above. Hereinafter, a pump-type and airtight liquid container according to another embodiment of the present disclosure will be described with reference to FIGS. 7 and 8.

Figure 7:
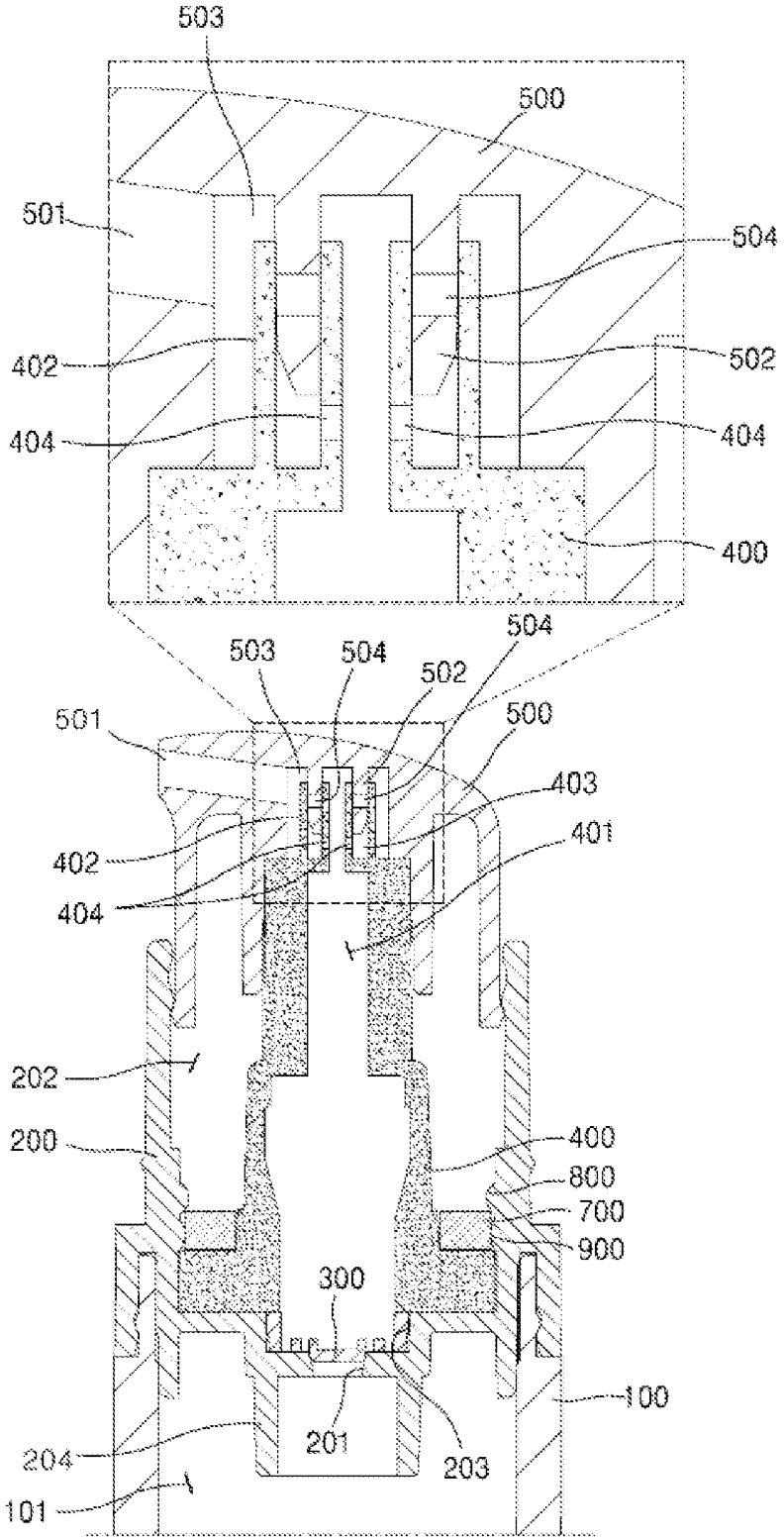
FIGS. 7 and 8 are partial cross-sectional views of a discharge tube of an elastic pump and a sealing protrusion ring of a discharge button according to another embodiment of the present disclosure.
Figure 8:
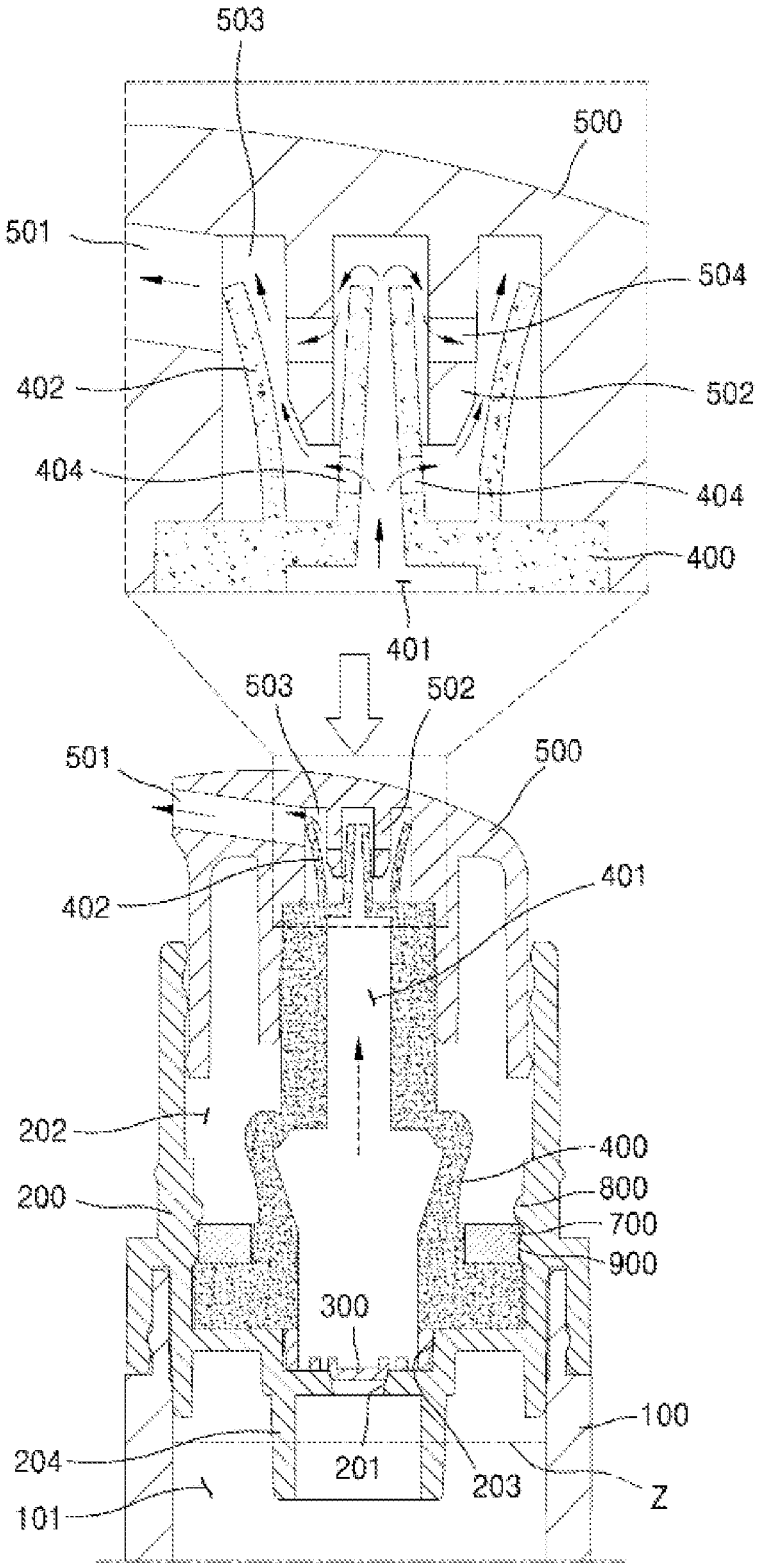

FIGS. 7 and 8 are partial cross-sectional views of a discharge tube 402 of an elastic pump 400 and a sealing protrusion ring 502 of a discharge button 500 according to another embodiment of the present disclosure.

As illustrated in the drawings, most elements in the present embodiment are similar to those of the above-described embodiment, except in terms of structures of the discharge tube 402 of the elastic pump 400 and the sealing protrusion ring 502 of the discharge button 500.

That is, the discharge tube 402 may include a fluid connecting port 404. The fluid connecting port 404 is provided in an inner portion of the discharge tube 402 having a dual structure, and places the movement passage 401 and the insertion groove 403 of the elastic pump 400 in communication with each other.

Meanwhile, the sealing protrusion ring 502 may preferably include a connection port 504. The connection port 504 is provided at an alternate position with respect to the fluid connecting port 404, and when the discharge button 500 is not raised, the sealing protrusion ring 502 is closed by the discharge tube 402 to keep the movement passage 401 in an airtight state (see FIG. 7).

The connection port 504 is opened by elimination of the discharge tube 402 when vacuum pressure is generated as the discharge button 500 is lowered and the elastic pump 400 is contracted, and thus the effect of moving the content that has passed by the movement passage 401 and the fluid connecting port 404, to the communication flow passage 503 and easily discharging the content to the discharge path 501.

According to the pump-type airtight liquid container of the present disclosure having the configuration as described above, liquid or gel content is accommodated in the accommodation space of the body, the connection cover including the communication port is coupled to the body to define the accommodation space, the checking plate opens or closes the communication port by vacuum pressure, the elastic pump inserted into the arrangement space of the connection cover contracts or restores to the previous position when the discharge button is raised and generates vacuum pressure in the movement passage, the airtight protrusion ring of the discharge button is closely adhered to the discharge tube of the elastic pump and airtightly seals the movement passage, the elastic pump allows the content to flow into the movement passage, and the shape of the discharge tube is changed via the vacuum pressure to discharge the content to the discharge path, thereby the pump-type airtight liquid container completely and effectively discharging the liquid or gel content due to its simplified structure, and increased airtightness.

Moreover, according to the pump-type airtight liquid container of the present disclosure, when a surface of the connection cover facing the lower end portion of the elastic pump is in contact with the lower end portion, the fixing ring is fixed in the annular space between the connection cover and the elastic pump, and when the fixing ring tends to move due to movement of the elastic pump, the fixing rib is brought into contact with the upper lateral surface of the fixing ring to increase the positional fixing force of the fixing ring, thereby preventing occurrence of a gap between the internal elements of the airtight liquid container and leakage of liquid between the internal elements when the liquid is discharged to the outside.

The effect according to the present disclosure is not limited to those described above, and other effects not mentioned herein will be clearly understood from the present disclosure by one of ordinary skill in the art.

It should be understood that embodiments described herein should be considered in a descriptive sense only and not for purposes of limitation. Descriptions of features or aspects within each embodiment should typically be considered as available for other similar features or aspects in other embodiments.

While one or more embodiments have been described with reference to the figures, it will be understood by those of ordinary skill in the art that various changes in form and details may be made therein without departing from the spirit and scope of the disclosure as defined by the following claims.

What is claimed is:

1. A pump-type airtight liquid container, comprising:

a body having a long cylindrical shape having an open upper portion to form an accommodation space to accommodate liquid content;

a connection cover inserted into the upper portion of the body to define the accommodation space and form an arrangement space having an open upper portion, the connection cover comprising a communication port at a lower portion thereof facing the accommodation space, wherein the accommodation space and the arrangement space communicate with each other via the communication port;

a checking plate mounted at the communication port and closing or opening the communication port when lowered or raised by vacuum pressure;

an elastic pump comprising a flexible material, having a long shape, and arranged in the arrangement space of the connection cover to move the content accommodated in the accommodation space, the elastic pump including a movement passage that communicates with the accommodation space and through which the content is moved in a length direction when the communication port is opened when the checking plate is raised;

a discharge button liftably inserted into the upper portion of the connection cover to discharge the content accommodated in the movement passage to the outside and comprising a discharge path that communicates with the outside and a sealing protrusion ring that is inserted into the movement passage to airtightly seal the movement passage, wherein, when the communication port is closed when the checking plate is lowered, the discharge button when lowered generates the vacuum pressure in the movement passage to deform a shape of the discharge tube of the elastic pump closely adhering to the sealing protrusion ring such that the discharge path and the movement passage communicate with each other; and a fixing ring fixed in an annular space between the connection cover and the elastic pump when a surface of the connection cover facing a lower end portion of the elastic pump is in contact with the lower end portion of the elastic pump installed in the connection cover to maintain sealing and prevent occurrence of a gap between the lower end portion of the elastic pump and the connection cover.

2. The pump-type airtight liquid container of claim 1, wherein the discharge button forms a communication flow passage connected to the discharge path when the shape of the discharge tube is modified by the vacuum pressure.

3. The pump-type airtight liquid container of claim 1, wherein the connection cover comprises an insertion portion having a concave shape in a lower portion of the connection cover, wherein the communication port is formed in a center of the insertion portion, wherein the checking plate comprises:

an insertion ring having a ring shape and being inserted into the insertion portion;

an opening and closing member having a shape corresponding to an inner shape of the communication port and opening or closing the communication port; and a plurality of connection ribs extending from an internal circumferential surface of the insertion ring to be connected to an outer circumferential surface of the opening and closing member such that the opening and closing member is raised when the opening and closing member is connected to the insertion ring.

4. The pump-type airtight liquid container of claim 1, further comprising: a push piston that has a plate shape and is liftably arranged in the accommodation space to move the content when the communication port is opened when the discharge button is raised, wherein the push piston pushes up the content to the movement passage when the push piston is raised by the vacuum pressure, divides the accommodation space, and forms an air inflow space in which the air is input through an inlet formed in a lower portion of the body.

5. The pump-type airtight liquid container of claim 1, wherein the discharge tube has a dual structure to increase airtightness of the movement passage and comprises an insertion groove into which the sealing protrusion ring is inserted and a plurality of fluid connection ports which are formed in a portion of the discharge tube in an inner position and via which the movement passage and the insertion groove communicate with each other, wherein the sealing protrusion ring comprises a connection port provided at an alternate position with respect to a fluid connecting port to easily discharge the content and allow the movement passage and the communication flow passage to communicate with each other.

* * * * *